US011591797B2

(12) United States Patent
Ferguson

(10) Patent No.: US 11,591,797 B2
(45) Date of Patent: Feb. 28, 2023

(54) INSULATED CONSTRUCTION MEMBER

(71) Applicant: Brandon Ferguson, Duncan (CA)

(72) Inventor: Brandon Ferguson, Duncan (CA)

( * ) Notice: Subject to any disclaimer, the term of this patent is extended or adjusted under 35 U.S.C. 154(b) by 28 days.

(21) Appl. No.: 17/389,655

(22) Filed: Jul. 30, 2021

(65) Prior Publication Data

US 2022/0049498 A1 Feb. 17, 2022

(30) Foreign Application Priority Data

Aug. 17, 2020 (CA) ..... CA 3090260

(51) Int. Cl.
*E04C 3/36* (2006.01)

(52) U.S. Cl.
CPC ..... *E04C 3/36* (2013.01)

(58) Field of Classification Search
CPC ..... E04C 3/36; E04C 3/16; E04C 3/291
See application file for complete search history.

(56) References Cited

U.S. PATENT DOCUMENTS 3,772,419 A * 11/1973 Schoening ..... B29C 70/28 428/119
4,224,774 A * 9/1980 Petersen ..... E04B 2/707 52/404.1
4,488,390 A * 12/1984 Mulford ..... E04D 13/178 52/407.1
4,658,557 A * 4/1987 Mulford ..... E04D 13/178 52/407.1
5,285,616 A * 2/1994 Tripp ..... E04C 3/36 52/DIG. 9
5,412,921 A * 5/1995 Tripp ..... E04C 3/28 52/DIG. 9
6,125,608 A * 10/2000 Charlson ..... F16B 33/02 52/847
8,516,778 B1 8/2013 Wilkens
9,103,113 B2 8/2015 Lockhart
9,677,264 B2 * 6/2017 Iverson ..... E04B 2/70
9,783,985 B2 10/2017 Iverson
10,731,332 B1 * 8/2020 Iverson ..... E04B 1/486
11,066,826 B2 * 7/2021 Wright ..... E04B 1/14
11,255,084 B2 * 2/2022 Iverson ..... E04C 3/36
11,346,104 B2 * 5/2022 Mikic ..... E04C 3/16
2002/0157329 A1 * 10/2002 Berdan, II ..... E04B 2/7411 52/144

(Continued)

*Primary Examiner* — Rodney Mintz
(74) *Attorney, Agent, or Firm* — Finch & Maloney PLLC

(57) ABSTRACT

An insulated construction member has a first wooden rail and a second wooden rail. The second wooden rail is positioned in parallel spaced relation to the first wooden rail. This parallel spaced relation creates a thermal break between the first wooden rail and the second wooden rail. A series of planar wooden connectors are positioned at spaced intervals along the length of the first wooden rail and the length of the second wooden rail. Each of the planar wooden connectors extends across the thermal break between the first wooden rail and the second wooden rail. A polymer insulation is positioned between the first wooden rail and the second wooden rail completely filling the thermal break. The polymer insulation encapsulates the series of planar wooden connectors, with the polymer insulation being reinforced by the series of planar wooden connectors.

10 Claims, 4 Drawing Sheets

(56) References Cited

U.S. PATENT DOCUMENTS

| | | | | |
|---|---|---|---|---|
| 2007/0283661 | A1* | 12/2007 | Daniels | E04C 3/36 52/745.12 |
| 2010/0037542 | A1* | 2/2010 | Tiberi | E04B 2/7457 52/656.1 |
| 2010/0236172 | A1* | 9/2010 | Wirth | E04B 1/26 52/309.4 |
| 2010/0300037 | A1* | 12/2010 | Turner | E04C 3/291 52/841 |
| 2011/0239573 | A1* | 10/2011 | Lockhart | E04B 2/7412 52/404.1 |
| 2012/0011793 | A1* | 1/2012 | Clark | E04C 3/29 156/305 |
| 2017/0009442 | A1* | 1/2017 | Iverson | E04C 3/29 |
| 2017/0247883 | A1* | 8/2017 | Iverson | E04C 3/122 |
| 2020/0080297 | A1* | 3/2020 | Wright | E04C 3/122 |
| 2020/0378119 | A1* | 12/2020 | Mikic | E04C 3/16 |
| 2020/0385976 | A1* | 12/2020 | Iverson | E04C 3/36 |
| 2021/0285206 | A1* | 9/2021 | Wright | E04C 3/16 |
| 2021/0388607 | A1* | 12/2021 | Wright | E04B 1/7654 |
| 2022/0080698 | A1* | 3/2022 | Laing | B32B 5/028 |

* cited by examiner

INSULATED CONSTRUCTION MEMBER

FIELD

There is described a construction member that is insulated to retard thermal transfer. This construction member was developed to serve as a wall stud, but it is now realized that the same principles can be applied in making top plates, bottom plates, and other construction members.

BACKGROUND

The concept of a wall stud with insulation to create a "thermal break" has been proposed in a number of existing patents, such as: U.S. Pat. No. 8,516,778 (Wilkens) titled "Insulated Wall Stud System"; U.S. Pat. No. 9,103,113 (Lockhart) titled "Wall Stud with a Thermal Break"; and U.S. Pat. No. 9,783,985 (Iverson) titled "Thermal Break Wood Stud with Rigid Insulation with Non-Metal Fasteners and Wall Framing System".

SUMMARY

There is provided an insulated construction member which has a first wooden rail and a second wooden rail. The first wooden rail has a length, a first end, a second end and at least one slotted opening oriented longitudinally along the length. The second wooden rail has a length, a first end, a second end and at least one slotted opening oriented longitudinally along the length. The second wooden rail is positioned in parallel spaced relation to the first wooden rail. This parallel spaced relation creates a thermal break between the first wooden rail and the second wooden rail. A series of planar wooden connectors are positioned at spaced intervals along the length of the first wooden rail and the length of the second wooden rail. Each of the planar wooden connectors extends across the thermal break between the first wooden rail and the second wooden rail. Each of the planar wooden connectors has a first edge and a second edge opposed to the first edge. The first edge engages the at least one slotted opening in the first wooden rail and the second edge engages the at least one slotted opening in the second wooden rail. A polymer insulation is positioned between the first wooden rail and the second wooden rail completely filling the thermal break. The polymer insulation encapsulates the series of planar wooden connectors with the polymer insulation being reinforced by the series of planar wooden connectors.

The insulated construction member, as described above, provides a thermal break between the first wooden rail and the second wooden rail which is filled with insulation.

As described above, there is at least one slotted opening in the first wooden rail and at least one slotted opening in the second wooden rail. There could be a series of discrete slotted openings for each of the series of planar wooden connectors. However, it is preferred that there be a single slotted opening that extends between the first end and the second end of the first wooden rail and a single slotted opening that extends between the first end and the second end of the second wooden rail. Each of the planar wooden connectors engages the same single slotted opening in the first wooden rail and the same single slotted opening in the second wooden rail. The planar wooden connectors are bonded at spaced intervals in the single slotted opening in the first wooden rail and the single slotted opening in the second wooden rail with glue. The remainder of each single slotted opening provides increased area for the foam bond, with the result that the insulation is retained more securely.

It is preferred that each of the planar wooden connectors is an hourglass shape, which is wide at the first edge, wide at the second edge, and relatively narrow at in a middle portion. The planar wooden connectors are wider at the first edge where connection is made with the first rail and at the second edge where the connection is made with the second rail. This wider connection point reduces twisting. The relatively narrower middle portion leaves more room for insulation and less area for thermal transfer along the planar wooden connector.

The middle portion of the planar wooden connectors has opposed side edges. It is preferred that each of the opposed side edges define a concave radius to minimize stress concentration at the middle portion.

The preferred materials for making the planar wooden connectors is either oriented strand board (OSB) or plywood. It will be appreciated that there may be other similar or substitute materials that could be used.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 3:
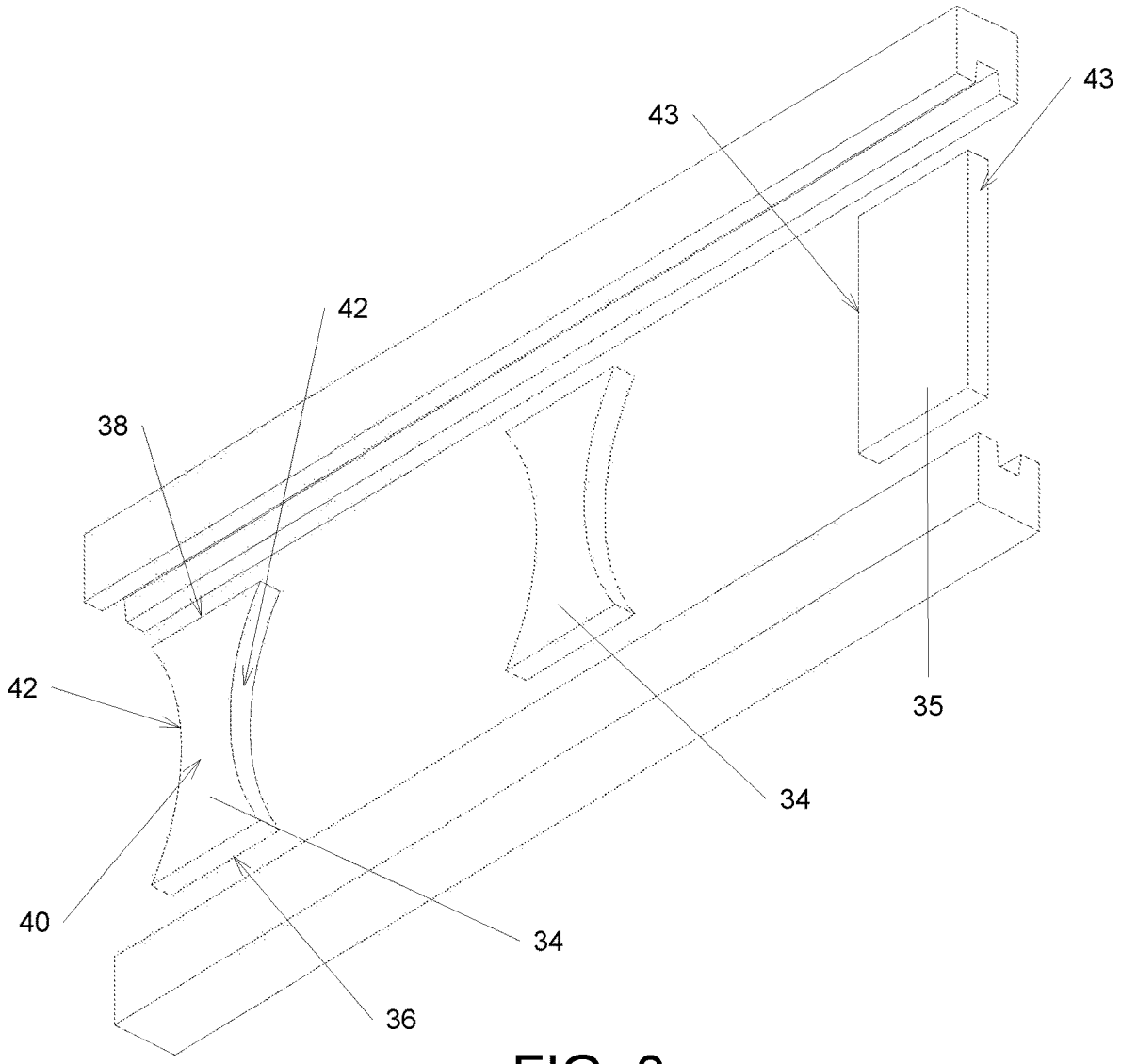
FIG. 3 is an exploded side elevation view of the insulated construction member of FIG. 3.
Figure 4:
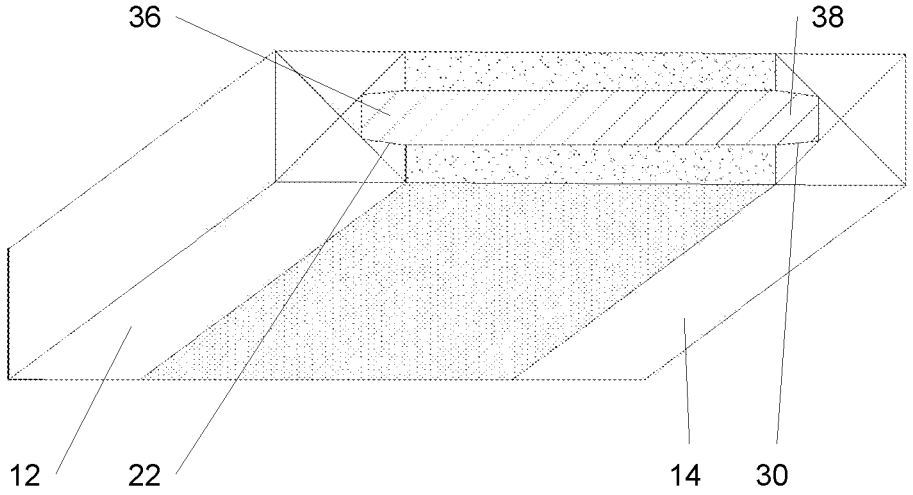
FIG. 4 is an end perspective view of a variant of the insulated construction member.

An insulated construction member generally identified by reference numeral 10, will now be described with reference to FIG. 1 through FIG. 3. A variant is shown in FIG. 4.

Figure 2:
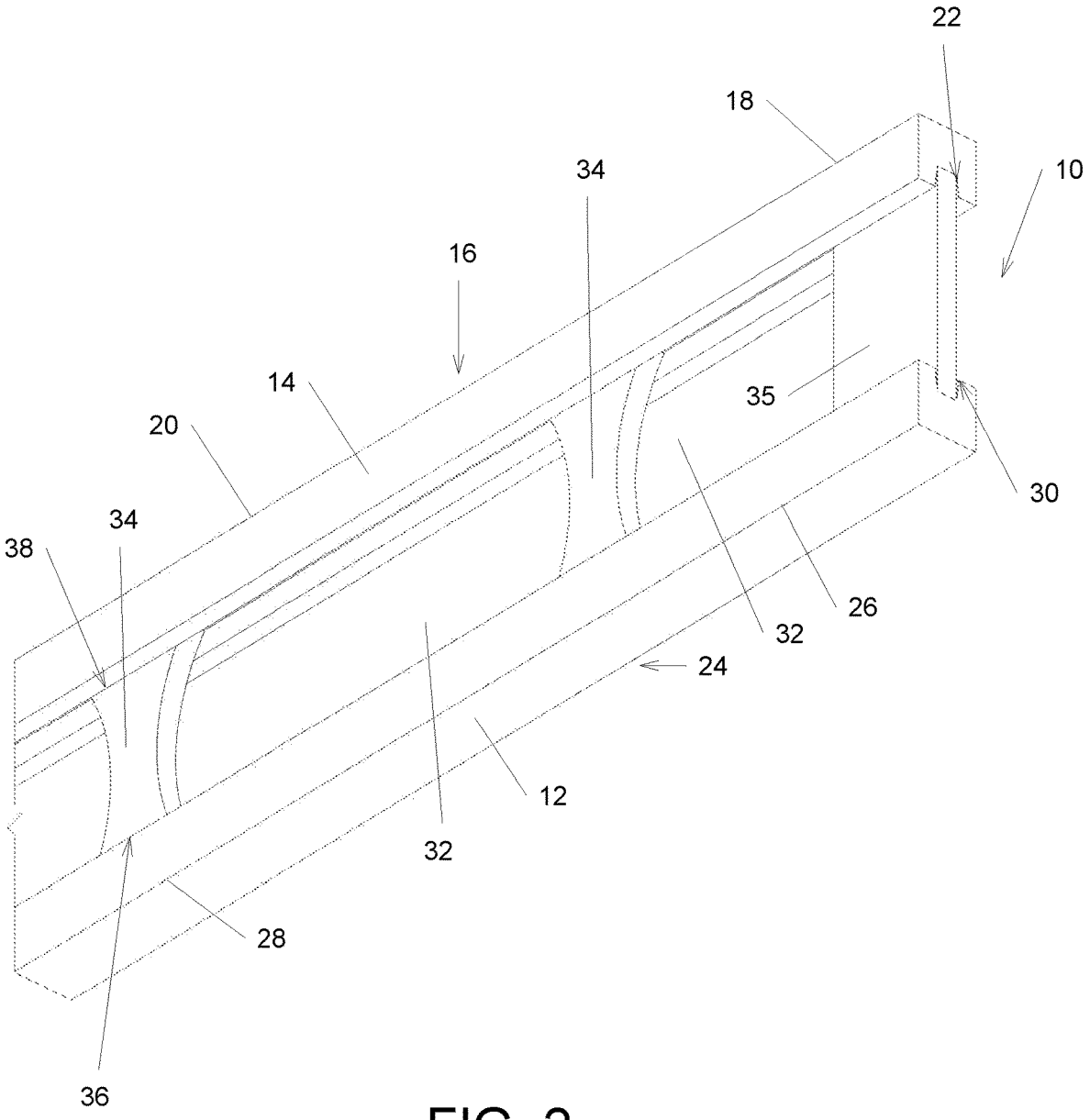
FIG. 2 is a side elevation view of the insulated construction member of FIG. 1, with polymer foam insulation removed.

Structure and Relationship of Parts:

Referring to FIG. 2, insulated construction member 10 includes a first wooden rail 12 and a second wooden rail 14. First wooden rail 12 has a length 16, a first end 18, a second end 20 and a single slotted opening 22 oriented longitudinally and extending along the entire length of first wooden rail 12 between first end 18 and second end 20. Second wooden rail 14 has a length 24, a first end 26, a second end 28 and a single slotted opening 30 oriented longitudinally and extending along the entire length of second wooden rail 12 between first end 26 and second end 28. Although not illustrated, alternatively, single slotted opening 22 and single slotted opening 30 could be a series of discrete slotted openings. Second wooden rail 14 is positioned in parallel spaced relation to first wooden rail 12, the parallel spaced relation creating a thermal break 32 between first wooden rail 12 and second wooden rail 14.

Referring to FIG. 2, a series of planar wooden connectors 34 are positioned at spaced intervals along the length of first wooden rail 12 and the length of second wooden rail 14. Each planar wooden connector 34 is extending across thermal break 32 between first wooden rail 12 and second wooden rail 14. Referring to FIG. 3, each planar wooden connector 34 has a first edge 36 and a second edge 38 opposed to first edge 36. As illustrated, first edge 36 and second edge 38 are straight edges. Referring to FIG. 2, first edge 36 is engaging single slotted opening 22 in first wooden rail 12 and second edge 38 is engaging single slotted opening 30 in second wooden rail 14. Referring to FIG. 3, each planar wooden connector 34 has an hourglass shape, which is wide at first edge 36, wide at second edge 38, and relatively narrow at in a middle portion 40. Middle portion 40 has opposed side edges 42, with each opposed side edge 42 defining a concave radius. It is to be noted that at first end 18 of first wooden rail 12 and first end 26 of second wooden rail 14, each end planar wooden connector 35 is rectangular in shape, with each opposed side edge 43 being straight edges. It is to be noted that at second end 20 of first wooden rail 12 and second end 28 of second wooden rail 14, each end planar wooden connector 35 is also rectangular in shape, with each opposed side edge 43 being straight edges. The reason for this is ensure that the ends are planar for finishing and connection. The studs have to be connected to top plates and bottom plates when framing a wall. Insulation will not hold nails. Having wood at the ends can be important when nailing the insulated construction member, especially when "toe nailing" is used. Although it is preferred that planar wooden connectors 34 have an hourglass shape, it will be understood that planar wooden connectors 34 could be rectangular. However, planar wooden connectors 34 are considered to provide advantages as outlined below.

Figure 1:
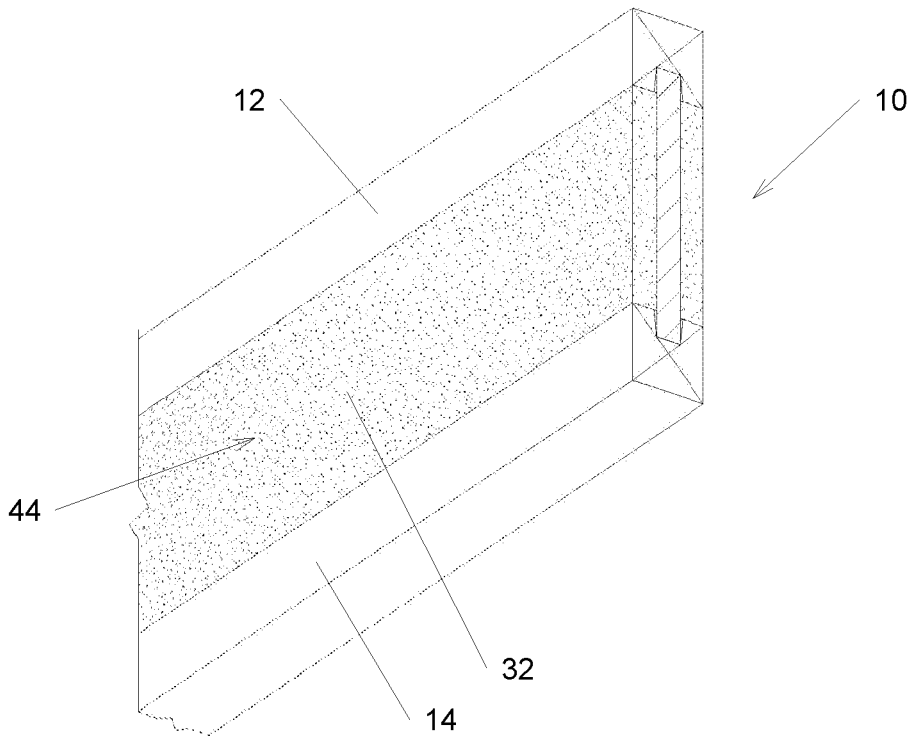
FIG. 1 is a perspective view of an insulated construction member.

Referring to FIG. 1, a polymer insulation 44 is filling thermal break 32 between first wooden rail 12 and second wooden rail 14. Polymer insulation 44 is encapsulating the series of planar wooden connectors 34 and being reinforced by the series of planar wooden connectors 34. Polymer insulation 44 is applied as a foam and fills slotted opening 22 and slotted opening 30. Once the foam has set, the engagement with slotted opening 22 and slotted opening 30 helps to secure polymer insulation 44 in place. It is preferred that polymer insulation 44 be fire-resistant.

Each of the planar wooden connectors 34 is made from oriented strand board (OSB) or made from plywood.

Advantages

In addition to the "obvious" advantages of reducing weight and improving thermal characteristics, there are a number of further advantages that the above described structure with the planar wooden connectors 34 provides that are worthy of noting:

Planar wooden connectors 34 maintain spacing between first rail 12 and second rail 14.

Planar wooden connectors 34 distribute loads between first rail 12 and second rail 14.

The hourglass shape of planar wooden connectors 34 serves an important purpose. Planar wooden connectors 34 are wider at first edge 36, where connection is made with first rail 12, and at second edge 38, where the connection is made with second rail 14. This wider connection point reduces twisting. The narrower middle portion 40 leaves more room for insulation and less area for thermal transfer along the planar wooden connector. Middle portion 40 of planar wooden connectors 34 has opposed side edges 42. It is preferred that each of the opposed side edges 42 define a concave radius to minimize stress concentration at middle portion 40.

The series of planar wooden connectors 34 maintains spacing of first rail 12 and second rail 14 for polymer foam insulation application, allow for greater amounts of foam insulation over and between planar wooden connectors 34 and, once planar wooden connectors 34 are encapsulated in the insulation, planar wooden connectors 34 serve to reinforce the insulation.

Referring to FIG. 4, a variant has been illustrated. It is to be noted that walls forming slotted opening 22 and slotted opening 30 have been angled outwardly by approximately 6 degrees. It is to be noted that first edge 36 and second edge 38 of planar wooden connector 34 and planar wooden connector 35 have been inwardly tapered by approximately 6 degrees. This tapered engagement is considered to improve performance. The tapered engagement assists with alignment when manufacturing. The tapered engagement helps with the application of glue joint pressure when gluing planar wood connector 34 and planar wood connector 35 in slotted opening 22 and slotted opening 30.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. An insulated construction member, comprising:

a first wooden rail having a length, a first end, a second end and at least one slotted opening oriented longitudinally along the length of the first wooden rail;

a second wooden rail having a length, a first end, a second end and at least one slotted opening oriented longitudinally along the length of the second wooden rail, the second wooden rail being positioned in parallel spaced relation to the first wooden rail, the parallel spaced relation creating a thermal break between the first wooden rail and the second wooden rail;

a series of planar wooden connectors positioned at spaced intervals along the length of the first wooden rail and the length of the second wooden rail, at least one of the planar wooden connectors is hourglass shaped, each of the planar wooden connectors extending across the thermal break between the first wooden rail and the second wooden rail, each of the planar wooden connectors having a first edge and a second edge opposed to the first edge, with the first edge engaging the at least one slotted opening in the first wooden rail and the second edge engaging the at least one slotted opening in the second wooden rail; and a polymer insulation is positioned between the first wooden rail and the second wooden rail completely filling the thermal break, the polymer insulation encapsulating the series of planar wooden connectors with the polymer insulation being reinforced by the series of planar wooden connectors.

2. The insulated construction member of claim 1, wherein the at least one slotted opening in the first wooden rail is a single slotted opening that extends between the first end and the second end of the first wooden rail and wherein the at least one slotted opening in the second wooden rail is a single slotted opening that extends between the first end and the second end of the second wooden rail.

3. The insulated construction member of claim 1, wherein each of the planar wooden connectors is made from oriented strand board (OSB).

4. The insulated construction member of claim 1, wherein each of the planar wooden connectors is made from plywood.

5. The insulated construction member of claim 1, wherein walls forming the slotted opening in the first wooden rail and walls forming the slotted opening in the second wood rail are angled outwardly and the first edge and the second edge of the planar wooden connectors have a mating inward taper.

6. The insulated construction member of claim 1, wherein each of the planar wooden connectors is hourglass shaped, which is wide at the first edge, wide at the second edge, and narrower at a middle portion thereof.

7. The insulated construction member of claim 6, wherein the middle portion having opposed side edges, each of the opposed side edges defining a concave radius.

8. An insulated construction member, comprising:

a first wooden rail having a length, a first end, a second end and a single slotted opening oriented longitudinally and extending along an entirety of the length of the first wooden rail between the first end and the second end;

a second wooden rail having a length, a first end, a second end and a single slotted opening oriented longitudinally and extending along an entirety of the length of the second wooden rail between the first end and the second end, the second wooden rail being positioned in parallel spaced relation to the first wooden rail, the parallel spaced relation creating a thermal break between the first wooden rail and the second wooden rail;

a series of planar wooden connectors positioned at spaced intervals along the length of the first wooden rail and the length of the second wooden rail, each of the planar wooden connectors extending across the thermal break between the first wooden rail and the second wooden rail, each of the planar wooden connectors having a first edge and a second edge opposed to the first edge, with the first edge engaging the slotted opening in the first wooden rail and the second edge engaging the slotted opening in the second wooden rail, each of the planar wooden connectors is hourglass shaped, which is wide at the first edge, wide at the second edge, and narrower at a middle portion thereof, the middle portion having opposed side edges, with each of the opposed side edges defining a concave radius; and a polymer insulation is positioned between the first wooden rail and the second wooden rail completely filling the thermal break, the polymer insulation encapsulating the series of planar wooden connectors with the polymer insulation being reinforced by the series of planar wooden connectors.

9. The insulated construction member of claim 8, wherein each of the planar wooden connectors is made from oriented strand board (OSB).

10. The insulated construction member of claim 8, wherein each of the planar wooden connectors is made from plywood.

* * * * *